United States Patent [19]

Cronin

[11] 3,982,493

[45] Sept. 28, 1976

[54] SKID CONTROL MECHANISM FOR BOATS

[76] Inventor: Charles W. Cronin, 3949 Kansas, San Diego, Calif. 92104

[22] Filed: June 26, 1975

[21] Appl. No.: 590,589

[52] U.S. Cl. ..... 114/144 R; 114/126; 114/152

[51] Int. Cl.[2] ..... B63H 25/44

[58] Field of Search ..... 114/56, 126, 142, 152, 114/150, 66.5 R, 66.5 S, 144 R, 146, 66.5 P

[56] References Cited

UNITED STATES PATENTS

| | | | |
|---|---|---|---|
| 517,864 | 4/1894 | Jessup | 114/126 |
| 2,998,791 | 9/1961 | Light | 114/66.5 S |
| 3,249,081 | 5/1966 | Schuster | 114/152 |

*Primary Examiner*—TM Blix
*Assistant Examiner*—Gregory W. O'Connor
*Attorney, Agent, or Firm*—Ralph S. Branscomb

[57] ABSTRACT

The invention is a skid control mechanism for a power boat and particularly for racing craft, comprising longitudinally hinged flaps mounted to opposite sides of the boat bottom and operable by steering mechanism or otherwise to deflect into an open, water-engaging position to prevent side slippage of the boat when making high-speed turns.

5 Claims, 5 Drawing Figures

SKID CONTROL MECHANISM FOR BOATS

BACKGROUND OF THE INVENTION

Power boats traveling at high speeds generally skid or side-slip considerably when making turns, and lose way which is especially important when racing. Although various leveler flap mechanisms have been invented which are attached to or near the stern of the boat for stabilizing a boat longitudinally, there is a need for a stabilizing, skid control mechanism for reducing side slippage during turns.

SUMMARY OF THE INVENTION

The present invention satisfies the abovementioned need and comprises longitudinally hinged deflectors or flaps which are seated in shallow wells in the bottom of the boat when the boat is on a straight course, and are alternatively swung downward by hydraulic cylinders or other power means when the boat is steered to the left or right to provide a positive purchase in the water during turns. The flaps may be provided as a single pair, preferably positioned generally laterally of the center of gravity, or two or more pairs may be used.

DETAILED DESCRIPTION OF THE PREFERRED EMBODIMENT

The skid control mechanism of the present invention is intended for use on power boats and particularly for small, high-speed craft such as that illustrated at 10. The bottom surface 12 is shown as having a slight V shape in FIG. 2, although the invention would function installed on most hull types.

Figure 2:
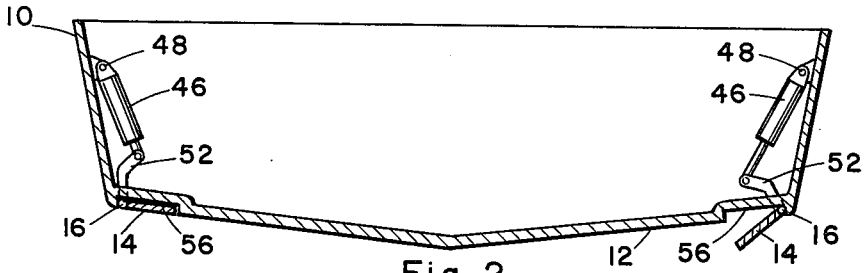
FIG. 2 is an enlarged sectional view taken on line 2—2 of FIG. 1.
Figure 3:
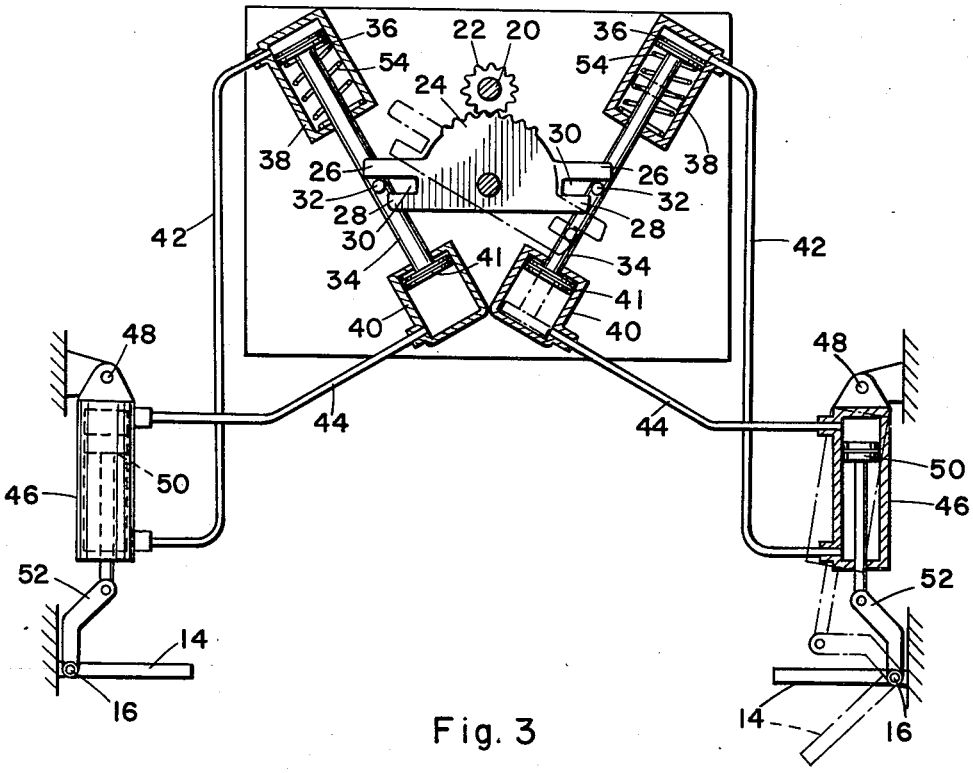
FIG. 3 is a diagram, with portions in section, of a hydraulic control system for the skid brakes.

Two rigid deflector flaps 14 are hinged at 16 to the opposite sides of the boat and are opened to track in the water when the boat is turned, as indicated by the right flap in FIGS. 2 and 3. Although both flaps could be opened simultaneously, it is preferred that only the flap on the inside of the turn be activated, and ideally operation of the flaps should be controlled automatically by the steering mechanism.

A diagrammatic illustration of one such steering control mechanism is shown in FIG. 3 in which the steering column 20 is provided with a spur gear 22 which engages a toothed actuator 24 having oppositely directed prong pairs 26 and 28 defining two slots 30 each of which engages one of two pins 32 projecting from rods 34.

The rods 34 have pistons 36 and 41 at the respective ends thereof, these pistons riding in hydraulic cylinders 38 and 40 which are connected by lines 42 and 44 to opposite ends of double-acting slave cylinders 46. Although this arrangement makes it appear that a left turn would activate the right flap, the positioning of the left and right flaps in the drawings could and probably would be reversed relative to the steering action in use. The slave cylinders are pivoted at 48 to the boat and drive pistons 50 which pivotally connect to lever arms 52 so that the entire slave cylinder mechanisms can pivot as shown in phantom in FIG. 3, and at the same time opening the respective flaps 14.

The operation of the steering actuation system should be clear from FIG. 3. When the steering wheel is turned left, the actuator 24 is driven to the right as shown in phantom so that one of the prongs 26 activates the right hand slave cylinder to swing the right flap outwardly. Upon returning the steering wheel to neutral, the actuator moves the right hand one of the pins 32 upwardly with the prong 28 which is shorter than prongs 26, so as the steering passes through neutral into a right turn, the pin slips past the shorter prong and the right hand hydraulic system is not affected by a greater degree of right hand turning. Return springs 54 are included in the cylinders 38 to ensure that the flaps do not drift open again when freed from the prongs 28.

Operation during and after a right hand turn is of course the reverse of above, and it should also be noted that the lines 42 and 44 must be somewhat flexible in the illustrated embodiment, and in the preferred form the flap mechanism diagrammatically shown on the right would actually be on the left side of the boat and vice versa. Although the flaps could be located relative to the steering shown, they would present an oblique angle to the water during a turn and not bite into the water as desired.

This particular means of deflecting the flaps as a function of, and powered by, the rotation of the steering columm is exemplary and not intended to be limited, as clearly equivalent or superior systems are a matter of engineering skill.

Figure 1:
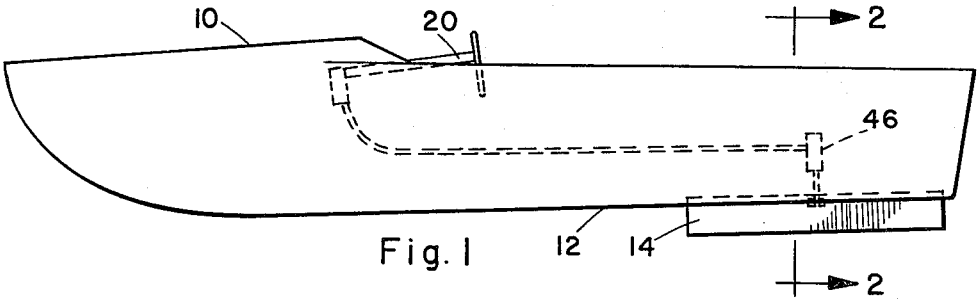
FIG. 1 is a side elevation view of a typical boat incorporating the skid brakes.
Figure 4:
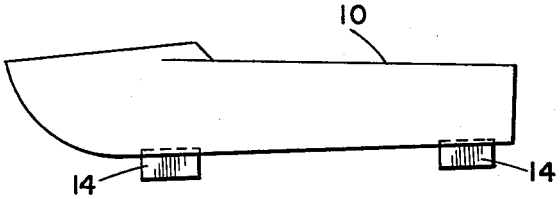
FIGS. 4 and 5 are side elevations view of boats with the skid brakes at alternative positions.
Figure 5:
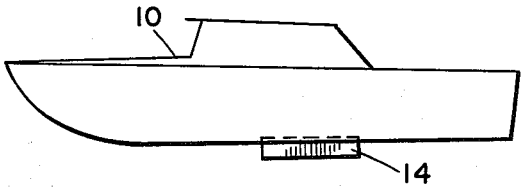

The flaps could be produced as an attachment to existing boats, which could be done without major modification of the hull, but when installed at the point of manufacture wells 56 should be formed in the hull to snugly seat the flaps and prevent distortion of the otherwise smoothly contoured hull when the flaps are in the neutral position. The location of the flaps could be toward the stern and thus near the propeller, as shown in FIG. 1, although the position shown in FIG. 5 is preferred, wherein the flaps are approximately lateral of the center of gravity of the boat, so that the steering function is not hindered and centrifugal turning force is not counter-productive to the steering effort. Another modification is shown in FIG. 4, in which a forward and an aft pair of flaps is provided.

I claim:

1. A skid control means for a boat having a steering mechanism comprising:

a. a pair of rigid flaps longitudinally hinged to opposite sides of the bottom of said boat and deflectable on the hinges thereof from a neutral position substantially flush with the bottom of said boat to an open, water-engaging position;

b. power means for moving said flaps between said neutral position and said water-engaging position;

c. said power means being positively and directly operated by said steering mechanism such that upon steering to the left, one of said flaps is activated, and upon steering to the right, the other of said flaps is activated.

2. Structrue according to claim 1 wherein said flaps are mounted substantially laterally of the center of gravity of said boat.

3. Structure according to claim 1 wherein said flaps are each deflected proportionally to the degree of right and left steerage, respectively.

4. Structure according to claim 3 wherein said flaps are each operated by a hydraulic cylinder, and including fluid pump means powered by said steering mechanism to operate said cylinders and capable of positively driving said flaps both into the open and into the closed position.

5. Structure according to claim 1 wherein the bottom of said boat is provided with a pair of wells, and said flaps are hinged along one respective side of said wells and seated therein in the neutral position whereby the smooth contour of the bottom surface of the boat is maintained.

* * * * *